US006725669B2

(12) United States Patent
Melaragni

(10) Patent No.: US 6,725,669 B2
(45) Date of Patent: Apr. 27, 2004

(54) THERMOELECTRIC COOLER TEMPERATURE CONTROL

(75) Inventor: William Melaragni, Billerica, MA (US)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/740,508

(22) Filed: Dec. 19, 2000

(65) Prior Publication Data

US 2002/0073716 A1 Jun. 20, 2002

(51) Int. Cl.[7] ..... F25B 21/02
(52) U.S. Cl. ..... 62/3.7
(58) Field of Search ..... 62/3.7, 3.2

(56) References Cited

U.S. PATENT DOCUMENTS 5,682,748 A * 11/1997 DeVibiss et al. ..... 62/3.7
5,689,957 A * 11/1997 DeVibiss et al. ..... 62/3.7
5,690,849 A * 11/1997 DeVibiss et al. ..... 219/497
5,872,624 A * 2/1999 Chambers et al. ..... 356/73.1
5,877,637 A * 3/1999 Trofimenkoff et al. ..... 327/101
6,074,089 A * 6/2000 Hollander et al. ..... 374/181
6,205,790 B1 * 3/2001 Denkin et al. ..... 62/3.7

* cited by examiner

*Primary Examiner*—William C. Doerrler
(74) *Attorney, Agent, or Firm*—Fish & Richardson P.C.

(57) ABSTRACT

A method and apparatus for controlling the temperature of a system are described. The method and apparatus use the Seebeck effect of a thermoelectric cooler. The apparatus includes a current source that generates current; a thermoelectric cooler having a first end and a second end connecting to the current source; and a control circuit. The control circuit monitors a voltage difference across the thermoelectric cooler and controls the current source according to the voltage difference. The voltage difference results in a temperature difference between the two ends of the thermoelectric cooler.

17 Claims, 3 Drawing Sheets

THERMOELECTRIC COOLER TEMPERATURE CONTROL

TECHNICAL FIELD

This invention relates generally to thermoelectric cooler temperature control, and more particularly to a method and apparatus for monitoring and stabilizing temperature of a heat-generating system using a thermoelectric cooler.

BACKGROUND

A Thermoelectric Cooler (TEC) is a cooling device that uses the Peltier effect for heat transfer. The Peltier effect occurs whenever electrical current flows through two dissimilar conductors. The two dissimilar conductors are connected through two junctions; one releases heat, and the other one absorbs heat.

Referring to FIG. 1, a TEC 15 can be constructed by soldering a semiconductor pellet 13 to electrically conductive material, typically plated copper (11 and 12), on each side of the pellet. The two ends of semiconductor pellet 13 are connected to a DC power supply 112 through a copper connection path 19. With this configuration, the first conductor of the two dissimilar conductors is semiconductor pellet 13, and the second conductor includes the plated copper (11 and 12) and copper connection path 19.

The Peltier effect is created by charge carriers that carry heat from one side of the pellet 13 to the other. For example, if an N-type semiconductor material is used to fabricate pellet 13, electrons will be the charge carriers. With a DC voltage source connected, electrons will be repelled by a negative pole 111 of power supply 112, and attracted by a positive pole 110 of the supply. The movement of the electrons flows in a counter-clockwise direction, as shown in FIG. 1. With the electrons flowing through the N-type material from bottom to top, heat is absorbed at the bottom junction and actively transferred to the top junction, and is effectively pumped by the electrons through semiconductor pellet 13. The heat moves in the direction of electron movement throughout the circuit.

To monitor and stabilize temperature in a system using a TEC, it is generally required that a thermistor, or some other temperature monitoring device with absolute accuracy, be mounted on a "cold" side, i.e., bottom plated copper 12, of the TEC. The output from the device controls a servo loop (not shown) for stabilizing the temperature.

SUMMARY

With typical applications of these devices, the cold side is generally enclosed in a heat-generating system. Therefore, mounting of a thermistor on the cold side has several drawbacks. For example, installing the thermistor on the cold side may require additional manufacturing processes that add to the final assembled cost of the system. Moreover, the reliability of the system and the yield can decrease due to the additional manufacturing processes and the possibility of failure of the monitoring device.

The invention relates to a method and apparatus for monitoring and stabilizing temperature in a heat-generating system using a thermoelectric cooler.

In a general aspect, the invention features a method and apparatus for temperature control using the Seebeck effect of a thermoelectric cooler, the method and apparatus including a current source that generates current; a thermoelectric cooler having a first end and a second end, both connecting to the current source; and a control circuit, which monitors voltage difference across the two ends of the thermoelectric cooler and controls the current source according to the voltage difference.

In another aspect, the invention features a method and apparatus that controls a temperature delta between the two ends of the thermoelectric cooler from the voltage difference. The voltage difference is used to derive the temperature delta and to calculate the polarity and magnitude of current that will bring the cooler to a desired temperature point. The control circuit activates the current source for a fixed duration of time, turns off the current source for measuring the voltage difference, and re-activates the current source according to the calculated current when the voltage difference after measuring the voltage difference. The control operations performed by the current source includes the operations of activation, deactivation, and re-activation of the current source, the operations being performed in a continuous cycle to maintain a substantially constant temperature delta across the two ends of the thermoelectric cooler.

In another aspect, the invention further features an external monitoring device mounted on a first end of the thermoelectric cooler for measuring an absolute temperature of the first end. The temperature of a second end of the thermoelectric cooler is stabilized based on an absolute temperature of the first end and temperature difference between the two ends.

The invention can be applied to any devices that use thermoelectric coolers for temperature control; for examples, LASER modules built by Nortel Networks, or tunable optical filters.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
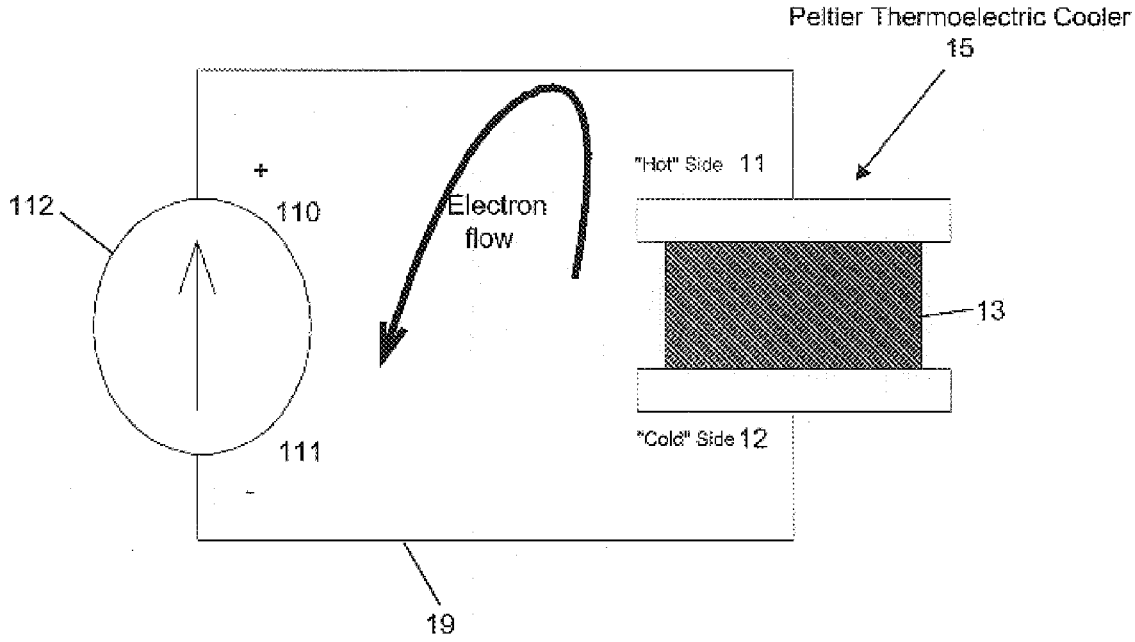
FIG. 1 (Prior Art)
FIG. 1 illustrates an example circuit that uses TEC.
Figure 2:
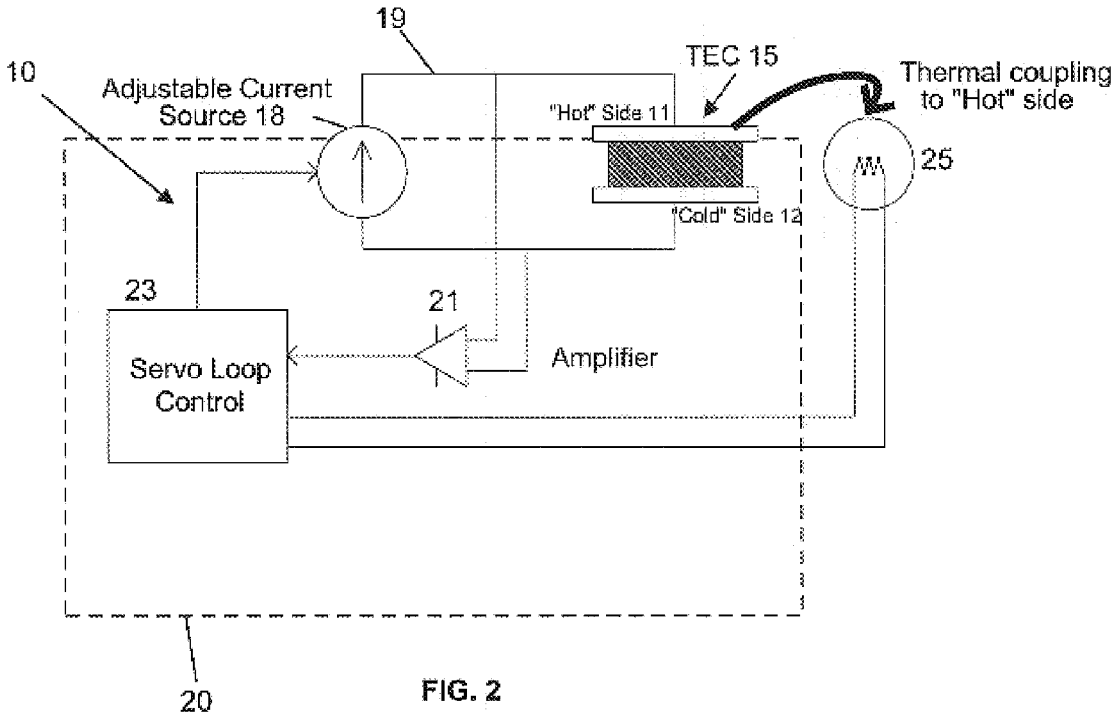
FIG. 2 is a circuit diagram including the TEC of FIG. 1 using Seebeck effect.

Referring to FIG. 2, a cooling circuit 10 includes a cooling device TEC 15 connected to an adjustable current source 18 through a conductive path 19 made of a conductive material, e.g., copper. TEC 15 includes a semiconductor pellet 13 that is soldered on both sides 11 and 12 to electrically conductive plates, which are usually made of a conductive plated material, e.g., copper. Each side of TEC 15 is connected to an input of an amplifier 21, which produces an output voltage proportional to the difference in voltage of its inputs. The output voltage feds a servo loop control 23 that adjusts the amount of current generated by current source 18.

Cooling circuit 10 is generally incorporated in a system 20 that generates heat in operation and requires heat dissipation. By passing current through TEC 15, the heat can be pumped from one side of the TEC to the other, which causes cooling of one side (i.e., cold side 12) and heating of the other (i.e., hot side 11). Cold side 12 is usually enclosed in system 20, while hot side 11 has an outer surface exposed to an external environment. The outer surface of hot side 11 dissipates the heat to the external environment, thus reducing the internal temperature of system 20.

An external temperature monitoring device 25, e.g., a thermistor, is mounted on the outer surface of hot side 11 for measuring absolute temperature of hot side 11. The hot side temperature, combined with a temperature difference between the two sides of TEC 15, provides a non-intrusive solution for monitoring the internal temperature of a system without requiring any temperature monitoring component internal to the system. A method for measuring the temperature delta will be described below.

The process of heat transfer from cold side 12 to hot side 11 is reversible. Just as the current flow causes heat transfer as described above; the movement of heat through an electrical conductor causes current to flow. Thus, when a temperature delta is applied across TEC 15, a voltage proportional to the temperature delta is generated. If an electrical load is placed across TEC 15, a corresponding current will flow. This phenomenon is known as the Seebeck effect. The voltage produced by the temperature difference is called the Seebeck voltage.

Referring again to FIG. 2, the Seebeck voltage can be measured as the difference in voltage at the inputs of amplifier 21. The temperature difference across TEC 15 can be derived from the Seebeck voltage by multiplying a constant coefficient obtained from a standard calibration procedure performed prior to the operation of system 20. Accordingly, the cold side temperature is equal to the hot side temperature, which is measured by temperature monitoring device 25, less the difference in temperature. That is, $T_{cold}=T_{hot}-T_{difference}$. Because cold side 12 is enclosed in system 20, the temperature of the cold side accurately estimates the internal temperature of the system. A connection path including servo loop control 23 and amplifier 21 forms a feedback control loop, which maintains temperature stability of system 20 by activating and deactivating current source 18 periodically.

Temperature monitoring device 25 need not be mounted on the TEC's cold side 12 as required by most conventional systems. Measuring the Seebeck voltage to estimate the temperature difference allows systems to be built and assembled without an internal thermistor. As a result, the use of Seebeck voltage advantageously eliminates the need to assemble thermistors into the modules.

Figure 3:
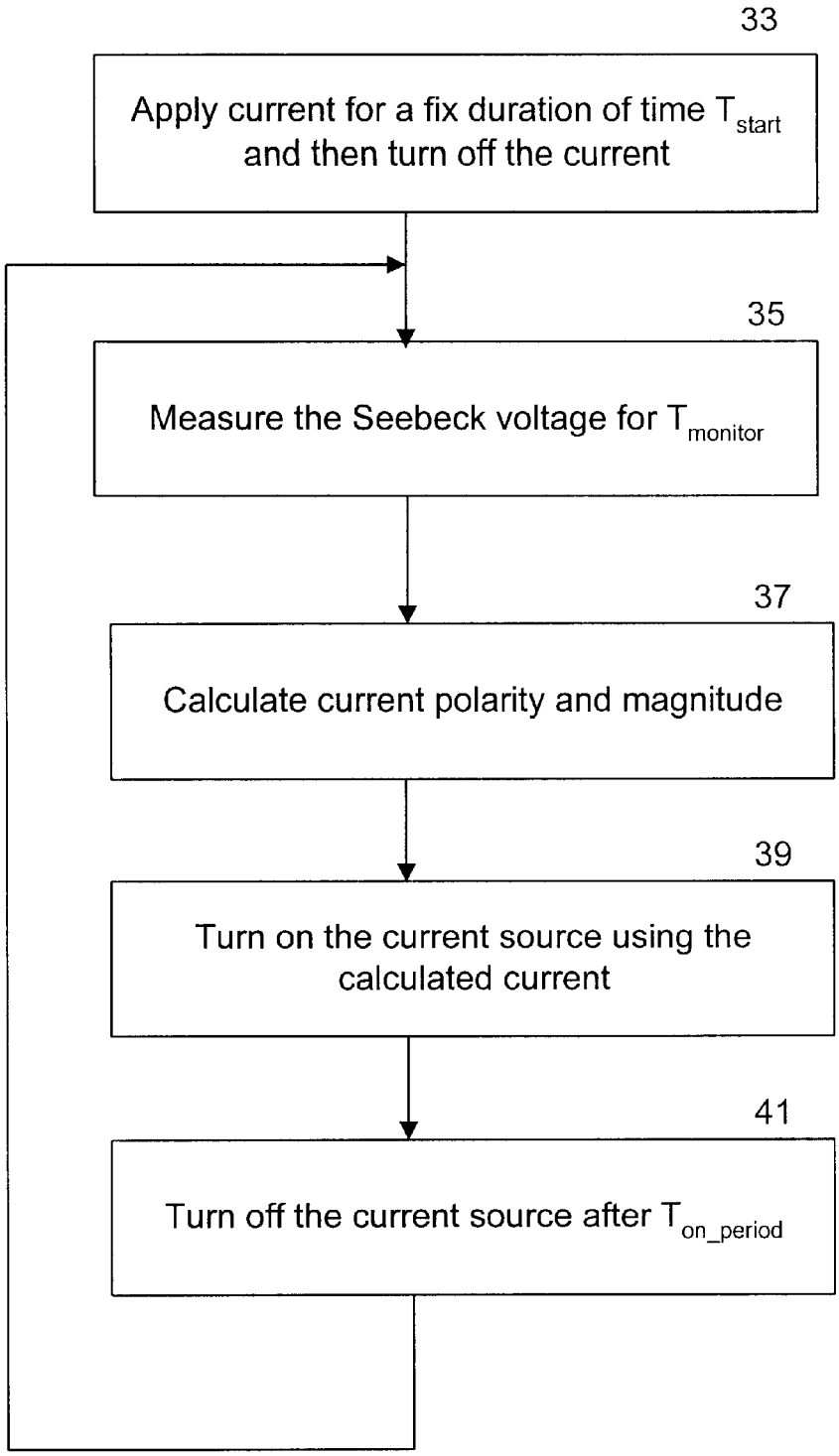
FIG. 3 is a flow diagram illustrating the process of using the circuit of FIG. 2 for stabilizing temperature.

Referring to FIG. 3, a process of maintaining temperature stability is illustrated. Current source 18 applies 33 current through TEC 15 for a fixed duration of time ($T_{start}$) and then turns off the current. After the current is turned off, servo loop control 23 measures 35 the Seebeck voltage across TEC 15 for a pre-determined time ($T_{monitor}$), e.g., 100 us, through amplifier 21. Based on the measured Seebeck voltage, the servo loop control 23 determines 37 the polarity and magnitude of current that should be generated to bring the TEC 15 to a desired temperature value. The current can be determined based on assumed characteristics of TEC 15.

For example, the current can be calculated by taking the TEC's thermal time constant, which indicates the response time for a certain temperature change, into account. Knowing the inherent delay in the TEC's temperature change, servo loop control 23 can adjust the current calculation to compensate for the delay. Servo loop control 23 then re-activates current source 18 to enable 39 the calculated current passing through TEC. After another pre-determined period of time ($T_{on_period}$), e.g., 10 ms, servo loop control turns off 41 current source 18 for measuring the Seebeck voltage again. In this manner, the process is performed in a continuous cycle, thus properly adjusting the temperature to maintain a substantially constant temperature difference across TEC 15.

For devices that are integrated with TECs, eliminating an integrated temperature monitor lowers assembled component cost, and failure rate of the device. Additionally, eliminating the temperature monitor also removes a manufacturing step and thus increases yield and manufacturing efficiency.

Other embodiments are within the scope of the following claims.

What is claimed is:

1. An apparatus for controlling temperature in an enclosed system comprising:

a thermoelectric cooler having a first end exposed to an external environment, and a second end enclosed in the system;

a temperature sensor mounted on the first end to measure an external temperature;

a current source coupled to the thermoelectric cooler to generate a current flowing through the thermoelectric cooler; and a control circuit, which monitors a voltage difference across the first and the second ends of the thermoelectric cooler and controls the current source based on the voltage difference and the external temperature.

2. The apparatus of claim 1 wherein the voltage difference is used to derive a temperature difference between the first and second ends of the thermoelectric cooler.

3. The apparatus of claim 1 wherein the voltage difference is used to derive a polarity and a magnitude of current that will bring the thermoelectric cooler to a desired temperature value.

4. The apparatus of claim 3 wherein the control circuit re-activates the current source according to the polarity and the magnitude of current.

5. The apparatus of claim 1 wherein the control circuit initially activates the current source for an initial period of time, and turns off the current source to measure the voltage difference.

6. The apparatus of claim 1 wherein the control circuit activates, deactivates, and re-activates the current source as a continuous cycle to maintain a substantially constant temperature difference across the first and second ends of the thermoelectric cooler.

7. The apparatus of claim 1 further comprising an external temperature monitoring device mounted on a first end of the thermoelectric cooler to measure an absolute temperature of the first end.

8. The apparatus of claim 1 wherein temperature of the system is stabilized according to the absolute temperature of the first end and temperature difference between the first and second ends of the thermoelectric cooler.

9. A method for controlling temperature in an enclosed system using a thermoelectric cooler comprising:

measuring a voltage difference across a thermoelectric cooler having a first end exposed to an external environment and a second end enclosed in the system;

measuring an external temperature using a temperature sensor mounted on the first end; and controlling a current source that generates current flowing through the thermoelectric cooler based on the voltage difference and the external temperature.

10. The method of claim 9 wherein the voltage difference is used to derive a temperature difference between the two ends.

11. The method of claim 9 wherein the voltage difference is used to derive a polarity and a magnitude of current that will bring the thermoelectric cooler to a desired temperature value.

12. The method of claim 11 wherein controlling the current source further comprises:

re-activating the current source according to the polarity and the magnitude of current.

13. The method of claim 9 wherein controlling the current source further comprises:

activating the current source for an initial period of time, and turning off the current source while measuring the voltage difference.

14. The method of claim 9 wherein controlling the current source further comprises:

activating, deactivating, and re-activating the current source in continuous cycles to maintain a substantially constant temperature difference across the first and second ends of the thermoelectric cooler.

15. The method of claim 9 further comprising:

measuring an absolute temperature of a first end of the thermoelectric cooler with an external monitoring device mounted on the first end.

16. The method of claim 9 further comprising:

stabilizing the temperature of the system based on an absolute temperature of the first end and temperature difference between the two ends.

17. The apparatus of claim 1 wherein the thermoelectric cooler is a peltier cooler.

* * * * *